US007513318B2

(12) United States Patent
Underwood et al.

(10) Patent No.: US 7,513,318 B2
(45) Date of Patent: Apr. 7, 2009

(54) STEERABLE UNDERREAMER/STABILIZER ASSEMBLY AND METHOD

(75) Inventors: Lance D. Underwood, Cypress, TX (US); Charles H. Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 235 days.

(21) Appl. No.: 11/333,945

(22) Filed: Jan. 18, 2006

(65) Prior Publication Data

US 2006/0113113 A1 Jun. 1, 2006

Related U.S. Application Data

(60) Continuation-in-part of application No. 10/841,314, filed on May 7, 2004, now Pat. No. 7,048,078, which is a division of application No. 10/078,067, filed on Feb. 19, 2002, now Pat. No. 6,732,817.

(51) Int. Cl.
*E21B 7/04* (2006.01)
*E21B 10/26* (2006.01)

(52) U.S. Cl. ..... 175/61; 175/385; 175/406

(58) Field of Classification Search ..... None
See application file for complete search history.

(56) References Cited

U.S. PATENT DOCUMENTS

| | | | |
|---|---|---|---|
| 3,224,507 | A | 12/1965 | Cordary et al. |
| 3,425,500 | A | 2/1969 | Fuchs |
| 4,055,226 | A | 10/1977 | Weber |
| 4,660,657 | A | 4/1987 | Furse et al. |
| 4,848,490 | A | 7/1989 | Anderson |
| 5,014,780 | A | 5/1991 | Skipper |
| 5,060,736 | A | 10/1991 | Neff |
| 5,113,953 | A | 5/1992 | Noble et al. |
| 5,168,941 | A | 12/1992 | Krueger et al. |
| 5,305,838 | A | 4/1994 | Pauc et al. |
| 5,307,885 | A | 5/1994 | Kuwana et al. |
| 5,318,137 | A | 6/1994 | Johnson et al. |

(Continued)

FOREIGN PATENT DOCUMENTS

BE 1012545 A3 12/2000

(Continued)

OTHER PUBLICATIONS

Combined Search and Examination Report issued in corresponding British Application No. GB0701000.2; Dated Apr. 18, 2007; 9 pages.

(Continued)

*Primary Examiner*—Zakiya W. Bates
(74) *Attorney, Agent, or Firm*—Osha • Liang LLP

(57) ABSTRACT

A bottom hole assembly includes a drill bit, a stabilized underreamer assembly located behind the drill bit, and a drilling assembly. A method to drill a formation includes positioning a stabilized underreamer assembly behind a drill bit, positioning a drilling assembly behind the stabilized underreamer assembly, and rotating the drill bit and stabilized underreamer assembly with the drilling assembly. A stabilized underreamer located between a directional drilling assembly and a drill bit includes at least one arm assembly extending from the stabilized underreamer assembly, wherein the arm assembly includes a stabilizer portion and an underreamer cutting structure.

23 Claims, 4 Drawing Sheets

U.S. PATENT DOCUMENTS

| | | | |
|---|---|---|---|
| 5,318,138 | A | 6/1994 | Dewey et al. |
| 5,332,048 | A | 7/1994 | Underwood et al. |
| 5,368,114 | A | 11/1994 | Tandberg et al. |
| 5,484,029 | A | 1/1996 | Eddison et al. |
| 5,520,255 | A | 5/1996 | Barr et al. |
| 5,765,653 | A | 6/1998 | Doster et al. |
| 5,857,531 | A | 1/1999 | Estep et al. |
| 5,875,859 | A | 3/1999 | Ikeda et al. |
| 5,971,085 | A | 10/1999 | Colebrook |
| 6,039,131 | A | 3/2000 | Beaton |
| 6,059,051 | A | 5/2000 | Jewkes et al. |
| 6,092,610 | A | 7/2000 | Kosmala et al. |
| 6,109,372 | A | 8/2000 | Dorel et al. |
| 6,213,226 | B1 | 4/2001 | Eppink et al. |
| 6,227,312 | B1 | 5/2001 | Eppink et al. |
| 6,269,893 | B1 | 8/2001 | Beaton et al. |
| 6,289,999 | B1 | 9/2001 | Dewey et al. |
| 6,360,831 | B1 | 3/2002 | Aakesson et al. |
| 6,378,632 | B1 | 4/2002 | Dewey et al. |
| 6,470,977 | B1 | 10/2002 | Chen et al. |
| 6,488,104 | B1 | 12/2002 | Eppink et al. |
| 6,494,272 | B1 | 12/2002 | Eppink et al. |
| 6,581,699 | B1 | 6/2003 | Chen et al. |
| 6,732,817 | B2 | 5/2004 | Dewey et al. |
| 6,769,499 | B2 | 8/2004 | Cargill et al. |
| 6,848,518 | B2 | 2/2005 | Chen et al. |
| 6,920,944 | B2 | 7/2005 | Eppink et al. |
| 2003/0155155 | A1 | 8/2003 | Dewey et al. |
| 2004/0134687 | A1 | 7/2004 | Radford et al. |
| 2005/0145417 | A1 | 7/2005 | Radford et al. |

FOREIGN PATENT DOCUMENTS

| | | |
|---|---|---|
| GB | 2 399 366 A | 9/2004 |

OTHER PUBLICATIONS

Office Action dated Jul. 4, 2008 issued by the Canadian Intellectual Property Office in a corresponding application, 3 pages.

STEERABLE UNDERREAMER/STABILIZER ASSEMBLY AND METHOD

CROSS-REFERENCE TO RELATED APPLICATIONS

The present application is a Continuation-In-Part of U.S. patent application Ser. No. 10/841,314 ("the '314 application"), filed on May 7, 2004. As such, the '314 application is a Divisional of U.S. patent application Ser. No. 10/078,067, filed on Feb. 19, 2002, now U.S. Pat. No. 6,732,817.

BACKGROUND OF INVENTION

Subterranean drilling operations are often performed to locate (exploration) or to retrieve (production) subterranean hydrocarbon deposits. Most of these operations include an offshore or land-based drilling rig to drive a plurality of interconnected drill pipes known as a drillstring. Large motors at the surface of the drilling rig apply torque and rotation to the drillstring, and the weight of the drillstring components provides downward axial force. At the distal end of the drillstring, a collection of drilling equipment known to one of ordinary skill in the art as a bottom hole assembly ("BHA"), is mounted. Typically, the BHA may include one or more of a drill bit, a drill collar, a stabilizer, a reamer, a mud motor, a rotary steering tool, measurement-while-drilling sensors, and any other device useful in subterranean drilling.

While most drilling operations begin as vertical drilling operations, often the borehole drilled does not maintain a vertical trajectory along its entire depth. Often, changes in the subterranean formation will dictate changes in trajectory, as the drillstring has natural tendency to follow the path of least resistance. For example, if a pocket of softer, easier to drill, formation is encountered, the BHA and attached drillstring will naturally deflect and proceed into that softer formation rather than a harder formation. While relatively inflexible at short lengths, drillstring and BHA components become somewhat flexible over longer lengths. As borehole trajectory deviation is typically reported as the amount of change in angle (i.e. the "build angle") over one hundred feet, borehole deviation can be imperceptible to the naked eye. However, over distances of over several thousand feet, borehole deviation can be significant.

Many borehole trajectories today desirably include planned borehole deviations. For example, in formations where the production zone includes a horizontal seam, drilling a single deviated bore horizontally through that seam may offer more effective production than several vertical bores. Furthermore, in some circumstances, it is preferable to drill a single vertical main bore and have several horizontal bores branch off therefrom to fully reach and develop all the hydrocarbon deposits of the formation. Therefore, considerable time and resources have been dedicated to develop and optimize directional drilling capabilities.

Typical directional drilling schemes include various mechanisms and apparatuses in the BHA to selectively divert the drillstring from its original trajectory. An early development in the field of directional drilling included the addition of a positive displacement mud motor in combination with a bent housing device to the bottom hole assembly. in standard drilling practice, the drillstring is rotated from the surface to apply torque to the drill bit below. With a mud motor attached to the bottom hole assembly, torque can be applied to the drill bit therefrom, thereby eliminating the need to rotate the drillstring from the surface. Particularly, a positive displacement mud motor is an apparatus to convert the energy of high-pressure drilling fluid into rotational mechanical energy at the drill bit. Alternatively, a turbine-type mud motor may be used to convert energy of the high-pressure drilling fluid into rotational mechanical energy. In most drilling operations, fluids known as "drilling muds" or "drilling fluids" are pumped down to the drill bit through a bore of the drillstring where the fluids are used to clean, lubricate, and cool the cutting surfaces of the drill bit. After exiting the drill bit, the used drilling fluids return to the surface (carrying suspended formation cuttings) along the annulus formed between the cut borehole and the outer profile of the drillstring. A positive displacement mud motor typically uses a helical stator attached to a distal end of the drillstring with a corresponding helical rotor engaged therein and connected through the mud motor driveshaft to the remainder of the BHA therebelow. As such, pressurized drilling fluids flowing through the bore of the drillstring engage the stator and rotor, thus creating a resultant torque on the rotor which is, in turn, transmitted to the drill bit below.

Therefore, when a mud motor is used, it is not necessary to rotate the drillstring to drill the borehole. Instead, the drillstring slides deeper into the wellbore as the bit penetrates the formation. To enable directional drilling with a mud motor, a bent housing is added to the BHA. A bent housing appears to be an ordinary section of the BHA, with the exception that a low angle bend is incorporated therein. As such, the bent housing may be a separate component attached above the mud motor (i.e. a bent sub), or may be a portion of the motor housing itself. Using various measurement devices in the BHA, a drilling operator at the surface is able to determine which direction the bend in the bent housing is oriented. The drilling operator then rotates the drillstring until the bend is in the direction of a desired deviated trajectory and the drillstring rotation is stopped. The drilling operator then activates the mud motor and the deviated borehole is drilled, with the drillstring advancing without rotation into the borehole (i.e. sliding) behind the BHA, using only the mud motor to drive the drill bit. When the desired direction change is complete, the drilling operator rotates the entire drillstring continuously so that the directional tendencies of the bent housing are eliminated so that the drill bit may drill a substantially straight trajectory. When a change of trajectory is again desired, the continuous drillstring rotation is stopped, the BHA is again oriented in the desired direction, and drilling is resumed by sliding the BHA.

One drawback of directional drilling with a mud motor and a bent housing is that the bend may create high lateral loads on the bit, particularly when the system is either kicking off (that is, initiating a directional change) from straight hole, or when it is being rotated in straight hole. The high lateral loads can cause excessive bit wear and a rough wellbore wall surface.

Another drawback of directional drilling with a mud motor and a bent housing arises when the drillstring rotation is stopped and forward progress of the BHA continues with the positive displacement mud motor. During these periods, the drillstring slides further into the borehole as it is drilled and does not enjoy the benefit of rotation to prevent it from sticking in the formation. Particularly, such operations carry an increased risk that the drillstring will become stuck in the borehole and will require a costly fishing operation to retrieve the drillstring and BHA. Once the drillstring and BHA is fished out, the apparatus is again run into the borehole where sticking may again become a problem if the borehole is to be deviated again and the drillstring rotation stopped. Furthermore, another drawback to drilling without rotation is that the effective coefficient of friction is higher, making it more difficult to advance the drillstring into the wellbore. This results in a lower rate of penetration than when rotating, and can reduce the overall "reach", or extent to which the wellbore can be drilled horizontally from the drill rig.

In recent years, in an effort to combat issues associated with drilling without rotation, rotary steerable systems ("RSS") have been developed. in a rotary steerable system, the BHA trajectory is deflected while the drillstring continues to rotate. As such, rotary steerable systems are generally divided into two types, push-the-bit systems and point-the-bit systems. in a push-the-bit RSS, a group of expandable thrust pads extend laterally from the BHA to thrust and bias the drillstring into a desired trajectory. An example of one such system is described in U.S. Pat. No. 5,168,941. In order for this to occur while the drillstring is rotated, the expandable thrusters extend from what is known as a geostationary portion of the drilling assembly. Geostationary components do not rotate relative to the formation while the remainder of the drillstring is rotated. While the geostationary portion remains in a substantially consistent orientation, the operator at the surface may direct the remainder of the BHA into a desired trajectory relative to the position of the geostationary portion with the expandable thrusters. An alternative push-the-bit rotary steering system is described in U.S. Pat. No. 5,520,255, in which lateral thrust pads are mounted on a body which is connected to and rotates at the same speed as that of the rest of the BHA and drill string. The pads are cyclically driven, controlled by a control module with a geostationary reference, to produce a net lateral thrust which is substantially in the desired direction.

In contrast, a point-the-bit RSS includes an articulated orientation unit within the assembly to "point" the remainder of the BHA into a desired trajectory. Examples of such a system are described in U.S. Pat. Nos. 6,092,610 and 5,875,859. As with a push-the-bit RSS, the orientation unit of the point-the-bit system is either located on a geostationary collar or has either a mechanical or electronic geostationary reference plane, so that the drilling operator knows which direction the BHA trajectory will follow. Instead of a group of laterally extendable thrusters, a point-the-bit RSS typically includes hydraulic or mechanical actuators to direct the articulated orientation unit into the desired trajectory. While a variety of deflection mechanisms exist, what is common to all point-the-bit systems is that they create a deflection angle between the lower, or output, end of the system with respect to the axis of the rest of the BHA. While point-the-bit and push-the-bit systems are described in reference to their ability to deflect the BHA without stopping the rotation of the drillstring, it should be understood that they may nonetheless include positive displacement mud motors to enhance the rotational speed applied to the drill bit.

Furthermore, in various formations, it is beneficial for the BHA to include a pilot bit and an underreamer to drill a full-gauge bore rather than a lone, single drill bit. In such an assembly, the smaller gauge pilot bit is located at the end of the BHA and is used to drill a pilot bore that is smaller than the final diameter of the borehole. An underreamer, or hole opener, is then located behind the pilot bit, where it is used to enlarge the pilot bore to a desired diameter. Typically, the underreamer must pass through casing that has been set in the previous section of wellbore. After exiting the casing, the underreamer is expanded below the casing to underream the wellbore.

As such, various systems have been proposed in the prior art to directionally drill subterranean boreholes using a BHA that comprises both a drill bit and an underreamer assembly. Particularly, U.S. Pat. No. 5,060,736 ("the '736 patent") discloses one such BHA. Referring initially to FIG. 1, a bottom hole assembly 100 in accordance with the '736 patent is depicted. Particularly, BHA 100 is shown creating a borehole 102 in a subterranean formation 104. Bottom hole assembly 100 of the '736 patent includes a pilot bit 106, a roller cone-type underreamer 108, and a drilling assembly 110. As depicted in FIG. 1, drilling assembly 110 directionally drills formation 104 through the use of a positive displacement mud motor for a drive mechanism 112 and a bent housing for a directional mechanism 114.

Furthermore, U.S. Pat. No. 6,059,051 ("the '051 patent") discloses alternative BHA assemblies. Referring now to FIG. 2, a BHA 150 is shown drilling a borehole 152 in a subterranean formation 154. Bottom hole assembly 150 of FIG. 2 includes a pilot bit 156, a first stabilizer 158, a roller cone-type underreamer 160 and a drilling assembly 162 in the order shown. As with FIG. 1, drilling assembly 162 of FIG. 2 includes a bent housing directional mechanism 164 and a mud motor 166 to directionally drill borehole 102 with pilot bit 156 and underreamer 160. Optionally, a second stabilizer 168 may be added to BHA 150 which may be located above (shown) or below drilling assembly 162. Furthermore, if present, second stabilizer 168 may be either a fixed or expandable gauge stabilizer. Finally, first stabilizer 158 may be fixed or rotatable with respect to formation 154.

Referring now to FIG. 3, an alternative BHA 200 in accordance with the '051 patent is shown drilling a borehole 202 in a subterranean formation 204. Bottom hole assembly 200 includes a pilot bit 206, a roller cone-type underreamer 208, an expandable stabilizer 210, a drilling assembly 212, and a second stabilizer 214. As before, drilling assembly 212 is depicted as including a bent housing directional mechanism 216 and a positive displacement mud motor 218. Furthermore, the '051 patent discloses that second stabilizer 214 may be located above (shown) or below drilling assembly 212.

Next, U.S. Pat. Nos. 6,470,977 and 6,848,518 ("the Chen patents") disclose another alternative BHA assembly. Referring now to FIG. 4, a BHA 250 in accordance with the Chen patents is shown drilling a borehole 252 in a subterranean formation 254. Bottom hole assembly 250 of FIG. 4 includes pilot bit 256 having a gauge section 258, a radial piston-type underreamer 260, and a drilling assembly 262 including a positive displacement mud motor 264 and a bent housing directional mechanism 266. Furthermore, gauge section 258 is described in the Chen patents as having the same diameter of pilot bit 264 and having an axial length of at least 75% of that diameter.

Embodiments of the present invention offer improvements over the known prior art in the field of directional drilling.

SUMMARY OF INVENTION

According to one aspect of the invention, a bottom hole assembly to drill a formation includes a drill bit, a drilling assembly comprising a drive mechanism and a directional mechanism, and a stabilized underreamer assembly located between the drill bit and the drilling assembly. Preferably, at least one arm assembly extends from the stabilized underreamer assembly, wherein the arm assembly includes a stabilizer portion and an underreamer cutting structure.

According to another aspect of the invention, a method to drill a formation includes positioning a stabilized underreamer assembly behind a drill bit, positioning a drilling assembly behind the stabilized underreamer assembly, and rotating the drill bit and stabilized underreamer assembly with the drilling assembly to penetrate the formation. Preferably at least one arm assembly of the stabilizer assembly includes an underreamer cutting structure and a stabilizer portion. Furthermore, the method preferably includes directing a trajectory of the drill bit and stabilized underreamer assembly with a directional mechanism of the drilling assembly.

According to another aspect of the invention, a stabilized underreamer located between a directional drilling assembly and a drill bit includes at least one arm assembly extending from the stabilized underreamer assembly, wherein the arm assembly includes a stabilizer portion and an underreamer cutting structure. The stabilized underreamer also preferably includes at least one axial recess, wherein a plurality of angled channels are formed into a wall of the at least one axial recess. Preferably, the at least one arm assembly translates along the plurality of angled channels between a collapsed position and an expanded position.

According to another aspect of the invention, a method to drill a borehole includes disposing a drill bit and a stabilized underreamer at a distal end of a drillstring, positioning a drilling assembly behind the stabilized underreamer, drilling a pilot bore with the drill bit and the drilling assembly, underreaming the pilot bore with underreamer cutters of the stabilized underreamer, and stabilizing the drill bit with stabilizer pads of the stabilized underreamer.

DETAILED DESCRIPTION

Embodiments of the invention relate generally to a drilling assembly to be used in subterranean drilling. More particularly, certain embodiments relate to a bottom hole assembly incorporating a stabilized underreamer located between a drill bit and a directional drilling assembly. in some embodiments, the drilling assembly includes a rotary steerable assembly and in other embodiments, the drilling assembly includes a downhole mud motor. Furthermore, in certain embodiments an expandable stabilizer is positioned above or upon the directional drilling assembly.

Figure 5:
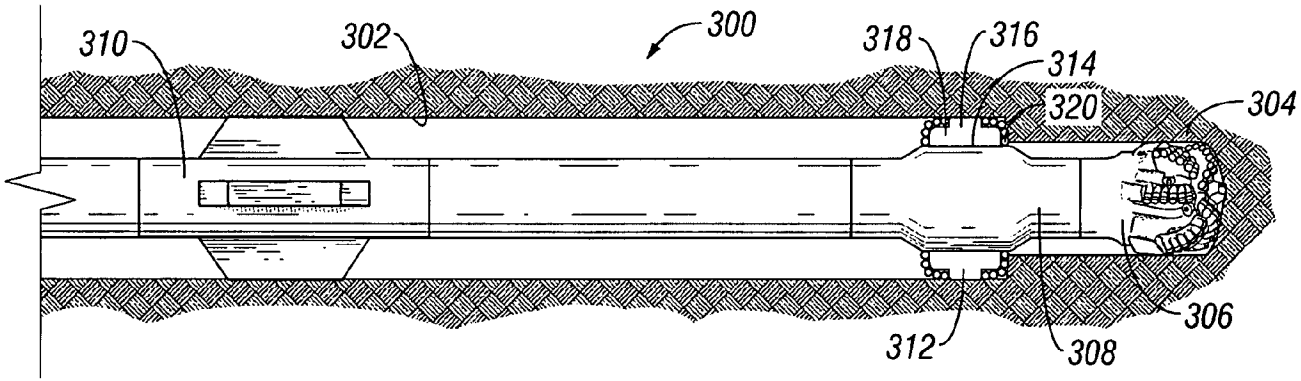
FIG. 5 is a schematic view drawing of a bottom hole assembly including a stabilized underreamer in accordance with embodiments of the present invention.

Referring now to FIG. 5, a bottom hole assembly as disclosed in U.S. Pat. No. 6,732,817 ("the 817 patent"), from which the present application claims benefit and is hereby incorporated by reference herein, is shown. Particularly, a BHA 300 is depicted drilling a borehole 302 in a subterranean formation 304. As such, BHA 300 includes a pilot bit 306, an expandable reamer 308, and an expandable stabilizer 310. Expandable reamer 308 shown includes a plurality of extendable arm assemblies 312, each configured to be slidably extended from and retracted into reamer 308. Arm assemblies 312 shown in FIG. 5 include underreamer cutters 314, a stabilizer portion 316, and optional backreamer cutters 318. As such, arm assemblies 312 are configured to be longitudinally and transversely dragged across borehole 302 while drag-type cutter elements 320 scrape formation 304 to enlarge a pilot bore 322 into enlarged borehole 302.

As arm assemblies 312 slidably engage formation 304, cutters 314, 318 and stabilizer portion 316 of FIG. 5 do not use roller-cone mechanisms to stabilize and underream pilot bores to a desired gauge. Roller-cone underreamers (e.g. 108, 160, 208, 260 of FIGS. 1-4) engage the hole wall with their gauge teeth, and as such have a predominantly side cutting action as opposed to a stabilizing action. For a BHA which makes directional changes through the use of a bend member to achieve the desired directional response, it is necessary for there to be a fulcrum point associated with the bend. in a directional drilling system, a fulcrum may be defined as a member which supports a load against the borehole wall in one direction, in order to force the bit against the borehole wall in the opposite direction. Therefore, a fulcrum member must have the ability to support a high side load. As such, the fulcrum member should have a predominantly stabilizing action as opposed to a side cutting action.

In contrast, a roller cone underreamer does not function well as a fulcrum or stabilization point, as the high side loads force the underreamer cone teeth deeper into the borehole formation than desired. As such, the more a reamer side cuts into the borehole wall in one direction, the less it is able to force the bit ahead to cut into the borehole wall in the opposite direction. As such, a drill bit connected to a roller-cone underreamer may not reliably achieve the desired directional trajectory. Furthermore, acting as a fulcrum impacts significant loads upon roller cones and may lead to their premature failure and wear.

In contrast to roller cone-type underreamers, arm assemblies 312 of FIG. 5 include both underreamer cutters 314 and stabilizer portions 316 adjacent to each other. Furthermore, stabilizer portions 316 are constructed with sufficient axial length along an axis of BHA 300 such that significant contact area between stabilizer portions 316 and borehole 302 results. Advantageously, whereas roller-cone underreamers have relatively minute contact areas with formation, stabilizer portions 316 engage formation 304 along several inches of axial length (and subsequently, several square inches of contact area) to prevent them from digging into the borehole wall. Furthermore, by placing stabilizer portions 316 on the same arm with underreamer cutters 314, stabilizer portions 316 are able to effectively limit the depth of cut of underreamer cutters 314. Furthermore, in former systems as described above, a separate underreamer trailing several feet behind a near-bit stabilizer with a directional tool therebehind may force the underreamer too far into the hole wall, resulting in excessive torque, vibration, and premature bit wear.

Additionally, stabilized underreamer 308 and drill bit 306 may be constructed as a single component, whereby arm assemblies 312 are located as close to the cutting structure of drill bit 306 as possible. An example of such an apparatus is described by U.S. patent application Ser. No. 11/334,195entitled "Drilling and Hole Enlargement Device" filed on Jan. 18, 2005 by inventors John Campbell, Charles Dewey, Lance Underwood, and Ronald Schmidt, hereby incorporated by reference herein in its entirety. Particularly, using such a unitary construction, arm assemblies 312 may be axially positioned within one to five times the cutting diameter of drill bit 306 cutting structure. For the purpose of this position, the distance is measured between the leading edge of drill bit 306 and the leading edge of arm assembly 312 when in the retracted position.

Figure 6:
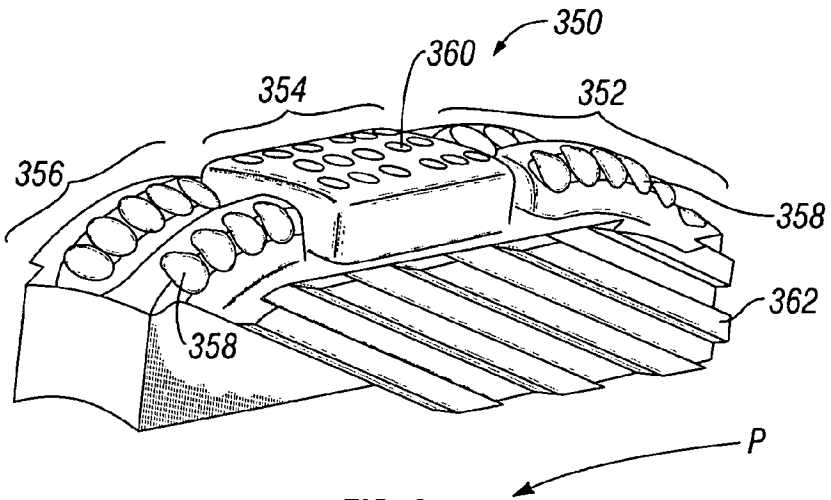
FIG. 6 is a profile view drawing of an arm assembly in accordance with embodiments of the present invention.

Referring now to FIG. 6, an arm assembly 350 in accordance with embodiments of the present invention is shown. Arm assembly 350 is configured to be extended from and retracted into an axial recess (not shown) located within the body of a stabilized underreamer (e.g. 308 of FIG. 5). As such, arm assembly 350 includes an underreamer cutting structure 352, a stabilizer portion 354, and an optional backreamer cutting structure 356. Cutting structures 352, 356 include a plurality of hardened cutter elements 358 arranged such that the formation is cut as arm assembly 350 is rotated tangentially thereagainst. While arm assembly 350 is shown having one ratio of underreamer cutters 352, stabilizer portion 354, and backreamer cutters 356, it should be understood that this proportion may be varied. Particularly, in certain formations, it may be advantageous to remove backreamer cutting structure 356 so that either stabilizer portion 354, a portion of underreamer cutters 352, or both may be axially lengthened.

Preferably, cutter elements 358 are constructed of thermally stable polycrystalline diamond compact, but other hardened substances (e.g. non-thermally stable PDC, CBN, Tungsten Carbide, or others) known to those of skill in the art may be used. Similarly, stabilizer portion 354 includes a plurality of hardened elements 360 to facilitate stabilization of arm assembly 350 against the formation. Hardened elements 360 may be any hardened, wear resistant material known to those skilled in the art, but typically are constructed as tungsten carbide inserts. Alternatively, welded, brazed, or plasma-sprayed hard metal coatings may be applied to stabilizer portion 354 of arm assembly 350. Next, the sides of arm assembly 350 include a plurality of angled channels 362 through which arm assemblies 350 are engaged and retracted into axial recesses of stabilized underreamer (308 of FIG. 5). Corresponding angled channels formed within walls of the axial recesses engage angled channels 362 and assist in extending arm assembly 350 out of an axial recess when thrust in direction P. Furthermore, as described in patent application Ser. No. 11/334,195 incorporated by reference above, differing angled channels may be used at different locations of arm assembly 350 so that stabilizer portion 354 extends into the formation after underreamer portion 352.

Figure 7:
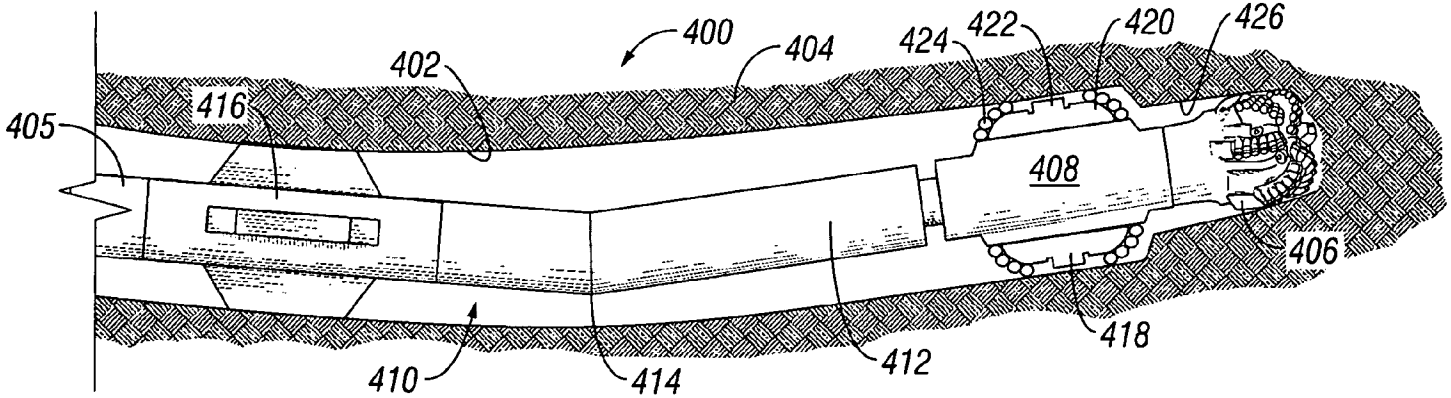
FIG. 7 is a schematic view drawing of a bottom hole assembly for use in directional drilling in accordance with an embodiment of the present invention.

Referring now to FIG. 7, a BHA 400 in accordance with an embodiment of the present invention is shown. Bottom hole assembly 400 is shown drilling a borehole 402 in a formation 404 at a distal end of a drillstring 405 and includes a drill bit 406, a stabilized underreamer 408, and a drilling assembly 410. Drilling assembly 410 is depicted as including a positive displacement mud motor 412 for a drive mechanism and a bent housing 414 for a directional mechanism. An expandable stabilizer 416 is optionally located above (shown) or upon drilling assembly 410. Stabilized underreamer 408 includes at least one arm assembly 418, wherein each arm assembly may include an underreamer cutting structure 420, a stabilizer portion 422, and an optional backreamer cutting structure 424. As such, drill bit 406 and stabilized underreamer 408 are simultaneously rotated, either by positive displacement mud motor 412 or by drillstring 405. When rotated by positive displacement mud motor 412, drill bit 406 and stabilized underreamer 408 drill a full gauge borehole 402 in a deviated trajectory related to the orientation and magnitude of a bend in bent housing 414. When a straight hole is desired, drill bit 406 and stabilized underreamer 408 are rotated by drillstring 405 such that the effects of bent housing 414 are eliminated. As such, arm assemblies 418 of stabilized underreamer 408 simultaneously stabilize drill bit 406 and underream a pilot bore 426 created by drill bit 406 into full gauge borehole 402.

Because arm assemblies 418 have stabilizer portions 422 in addition to underreamer cutting structure 420, stabilized underreamer 408 is able to stabilize BHA 400 as well as side-cut formation 404. Furthermore, slidably engagable arm assemblies 418 are significantly stronger and more robust than pivotally attached arms found in the prior art. By integrating underreamer cutting structure 420 with stabilizer portion 422, the stabilizer action takes place as close as possible to the cutting action, thereby protecting underreamer cutting structure 420 from lateral vibrations. Furthermore, integrating the stabilizer portion 422 with underreamer cutting structure 420 allows stabilizer pads to be brought essentially to full gauge, thereby virtually eliminating lateral clearance and the opportunity for their lateral movement and vibration. As such, stabilizer portion 422 will prevent underreamer cutting structure 420 from cutting too deep into the formation, thereby protecting cutting structure 420 and minimizing whirl.

Figure 8:
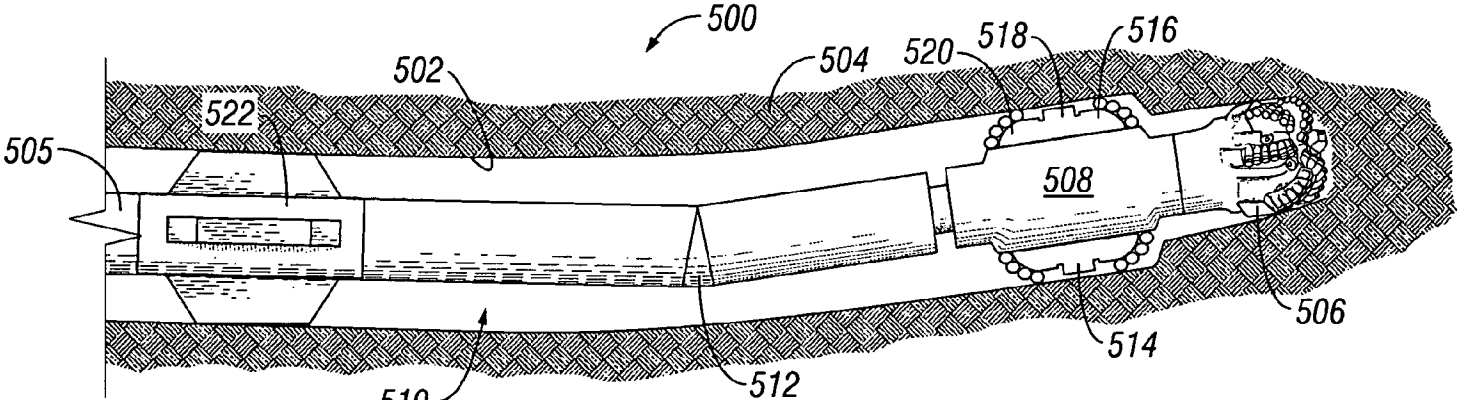
FIG. 8 is a schematic view drawing of a bottom hole assembly for use in directional drilling in accordance with an embodiment of the present invention.

Using a stabilized underreamer in accordance with embodiments of the present invention, a point-the-bit RSS may now be used in directional underreaming operations with the underreaming taking place within a few feet of the pilot bit. Referring briefly to FIG. 8, a BHA 500 is shown drilling a borehole 502 in a formation 504 at a distal end of a drillstring 505. Bottom hole assembly 500 includes a drill bit 506, a stabilized underreamer 508, and a drilling assembly 510. Drilling assembly 510 is a point-the-bit type directional assembly that includes an articulated, geo-stationary joint 512 (i.e., one that is configured to remain in a fixed position relative to formation 504 while drillstring 505 is rotated). Therefore, drillstring 505 acts as the drive mechanism and articulated joint 512 acts as the directional mechanism for drilling assembly 501.

Figure 1:
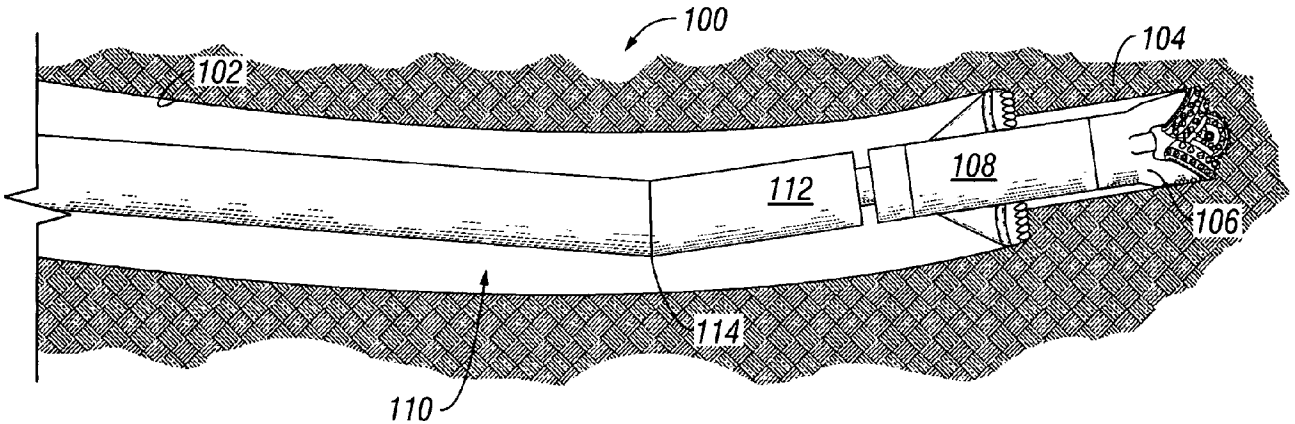
FIG. 1 (Prior Art)
FIG. 1 is a schematic view drawing of a first bottom hole assembly for use in directional drilling in accordance with the prior art.
Figure 2:
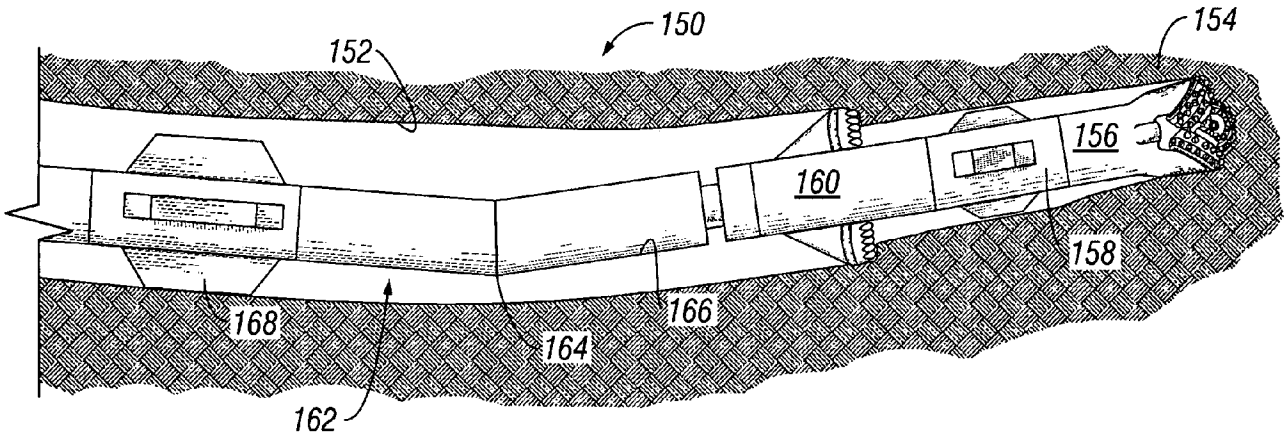
FIG. 2 (Prior Art)
FIG. 2 is a schematic view drawing of a second bottom hole assembly for use in directional drilling in accordance with the prior art.
Figure 3:
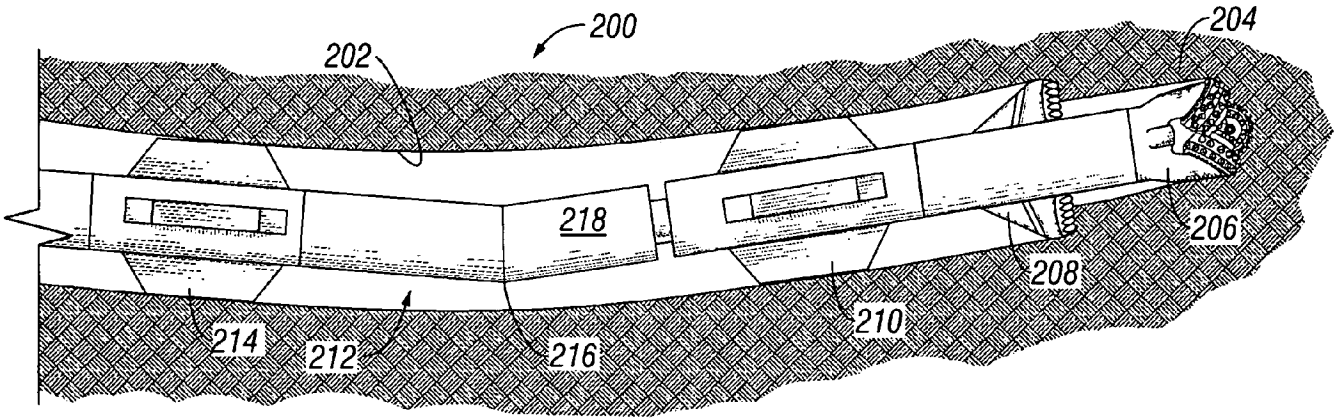
FIG. 3 (Prior Art)
FIG. 3 is a schematic view drawing of a third bottom hole assembly for use in directional drilling in accordance with the prior art.
Figure 4:
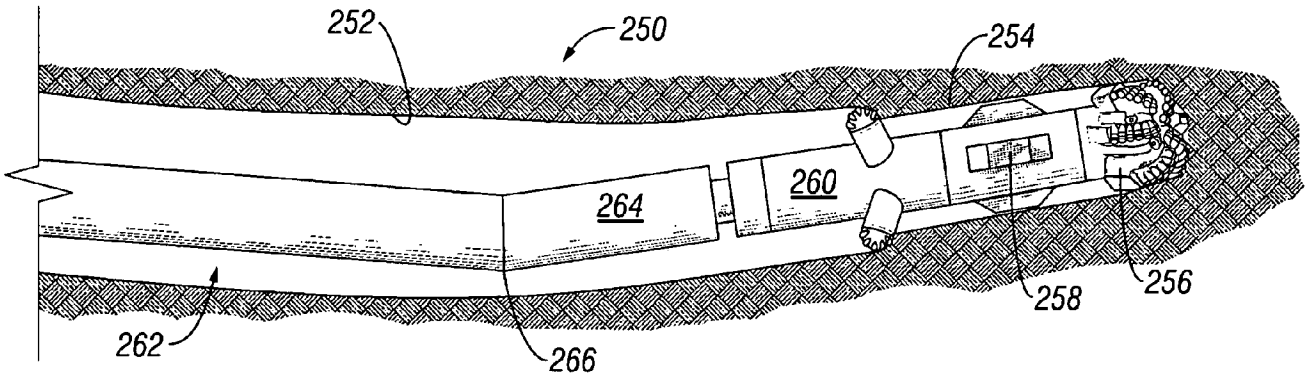
FIG. 4 (Prior Art)
FIG. 4 is a schematic view drawing of a fourth bottom hole assembly for use in directional drilling in accordance with the prior art.

As with stabilized underreamer 408 of FIG. 4, stabilized underreamer 508 of FIG. 5 includes at least one arm assembly 514 that includes underreamer cutting structure 516 and a stabilizer portion 518. Optionally, a backreamer cutting structure 520 may also be present. As such, the integrated stabilizer portion 518 adjacent to underreamer cutting structure 516 offers the best opportunity to minimize lateral vibrations and whirl that would otherwise damage articulated joint 512 of RSS drilling assembly 501. Furthermore, optional expandable stabilizer 522 may be positioned within BHA 500 above (shown) or upon drilling assembly 510.

Advantageously, certain embodiments of the present invention exhibit reduced lateral vibrations and whirl such that delicate RSS components are more effectively protected. Additionally, certain embodiments of the present invention offer further improvements over prior art systems using bi-centered drill bits in that lateral vibrations caused by their inherent mass imbalance are avoided.

While certain geometries and materials for a stabilized underreamer in accordance with an embodiment of the present invention are shown, those having ordinary skill in the art will recognize that other geometries and/or materials may be used. Furthermore, as stated above, selected embodiments of the present invention allow a bottom hole assembly to be constructed and used to enable directional drilling with increased stability.

While preferred embodiments of this invention have been shown and described, modifications thereof may be made by one skilled in the art without departing from the spirit or teaching of this invention. The embodiments descried herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed:

1. A bottom hole assembly to drill a formation, the bottom hole assembly comprising:

a drill bit;

a drilling assembly comprising a drive mechanism and a directional mechanism;

a stabilized underreamer assembly located between the drill bit and the drilling assembly; and at least one arm assembly extending from the stabilized underreamer assembly, the arm assembly including a stabilizer portion and an underreamer cutting structure.

2. The bottom hole assembly of claim 1, wherein the stabilized underreamer assembly further comprises:

at least one axial recess, wherein a plurality of angled channels are formed into a wall of the at least one axial recess; and wherein the at least one arm assembly translates along the plurality of angled channels between a collapsed position and an expanded position.

3. The bottom hole assembly of claim 1, wherein the at least one arm assembly translates axially and radially between a collapsed position and an expanded position.

4. The bottom hole assembly of claim 1, wherein the drive mechanism includes a positive displacement mud motor.

5. The bottom hole assembly of claim 1, wherein the directional mechanism comprises at least one selected from the group consisting of a rotary steerable device and a bent housing.

6. The bottom hole assembly of claim 1, wherein the stabilized underreamer assembly further comprises backreamer cutters.

7. The bottom hole assembly of claim 1, wherein the stabilized underreamer assembly is integral with the drill bit.

8. The bottom hole assembly of claim 1, wherein the stabilized underreamer assembly is located behind the drill bit by a distance between one to five times a cutting diameter of the drill bit.

9. The bottom hole assembly of claim 1, further comprising an expandable stabilizer assembly located uphole of the directional mechanism of the drilling assembly.

10. The bottom hole assembly of claim 1, wherein the underreamer cutting structure comprises at least one of the group consisting of polycrystalline diamond compact cutters, hard metal inserts, and impregnated natural diamond.

11. The bottom hole assembly of claim 1, wherein the stabilizer portion of the arm assembly is configured to engage the formation after the underreamer cutting structure engages the formation.

12. A method to drill a formation, the method comprising:

positioning a stabilized underreamer assembly behind a drill bit, wherein at least one arm assembly of the stabilizer assembly includes an underreamer cutting structure and a stabilizer portion;

positioning a drilling assembly behind the stabilized underreamer assembly;

rotating the drill bit and stabilized underreamer assembly with the drilling assembly to penetrate the formation; and directing a trajectory of the drill bit and stabilized underreamer assembly with a directional mechanism of the drilling assembly.

13. The method of claim 12, wherein the stabilized underreamer assembly further comprises:

at least one axial recess, wherein a plurality of angled channels are formed into a wall of the at least one axial recess;

wherein the at least one arm assembly translates along the plurality of angled channels between a collapsed position and an expanded position.

14. The method of claim 13, further comprising translating the at least one arm assembly along the plurality of angled channels to engage the formation with the underreamer cutting structure and the stabilizer portion.

15. The method of claim 12, further comprising engaging the formation with the underreamer cutting structure before engaging the formation with the stabilizer portion.

16. The method of claim 12, further comprising:

drilling a pilot bore with the drill bit; and underreaming the formation with the stabilized underreamer assembly.

17. The method of claim 12, wherein a directional mechanism of the drilling assembly includes at least one of the group consisting of a rotary steerable assembly, a bent housing, and an articulated sub.

18. The method of claim 12, further comprising stabilizing the drilling assembly with an expandable stabilizer assembly.

19. A stabilized underreamer located between a directional drilling assembly and a drill bit, the stabilized underreamer comprising:

at least one arm assembly extending from the stabilized underreamer assembly, the arm assembly including a stabilizer portion and an underreamer cutting structure;

at least one axial recess, wherein a plurality of angled channels are formed into a wall of the at least one axial recess; and wherein the at least one arm assembly translates along the plurality of angled channels between a collapsed position and an expanded position.

20. The stabilized underreamer of claim 19, wherein the stabilizer portion is configured to engage a formation after the underreamer cutting structure engages the formation.

21. A method to directionally drill a subterranean formation, comprising assembling the stabilized underreamer of claim 19 into a bottom hole assembly.

22. A method of drilling a borehole comprising:

disposing a drill bit and a stabilized underreamer at a distal end of a drillstring;

positioning a drilling assembly behind the stabilized underreamer;

drilling a pilot bore with the drill bit and the drilling assembly;

underreaming the pilot bore with underreamer cutters of the stabilized underreamer; and stabilizing the drill bit with stabilizer pads of the stabilized underreamer.

23. The method of claim 22, wherein the stabilized underreamer is integrated with the drill bit.

* * * * *